United States Patent [19]

Green et al.

[11] 4,450,693

[45] May 29, 1984

[54] CRYOGENIC COOLER THERMAL COUPLER

[75] Inventors: Kenneth E. Green, Westford; John A. Talbourdet, Danvers, both of Mass.

[73] Assignee: Honeywell Inc., Minneapolis, Minn.

[21] Appl. No.: 497,779

[22] Filed: May 24, 1983

[51] Int. Cl.[3] ..... F25B 19/00

[52] U.S. Cl. ..... 62/514 R; 165/185; 250/352

[58] Field of Search ..... 62/514 R; 165/185; 250/332, 352

[56] References Cited

U.S. PATENT DOCUMENTS

| | | | |
|---|---|---|---|
| 3,609,992 | 10/1971 | Cacheux | 62/514 R |
| 3,742,729 | 7/1973 | Zulliger | 62/514 R |
| 3,807,188 | 4/1974 | Lagodmos | 62/514 R |
| 3,851,173 | 11/1974 | Taylor et al. | 62/514 R |
| 3,999,403 | 12/1976 | Bower et al. | 62/514 R |
| 4,412,427 | 11/1983 | Horn et al. | 62/514 R |

*Primary Examiner*—Ronald C. Capossela

*Attorney, Agent, or Firm*—John S. Solakian; Laurence J. Marhoefer

[57] ABSTRACT

A thermal coupler assembly mounted to the coldfinger of a cryogenic cooler which provides improved thermal transfer between the coldfinger and the detector assembly mounted on the dewar endwell. The thermal coupler design comprises a stud and spring-loaded cap mounted on the coldfinger assembly. Thermal transfer is made primarily through the air space between the cap and coldwell walls along the radial surfaces. The cap is spring loaded to provide thermal contact between the cap and endwell end surfaces.

8 Claims, 2 Drawing Figures

CRYOGENIC COOLER THERMAL COUPLER

BACKGROUND OF THE INVENTION

The present invention relates to infrared energy receivers which use a cryogenic refrigerator to cool an infrared detector assembly, and more specifically to the design of the thermal interface between the refrigerator and the vessel which holds the detector assembly.

In infrared receivers, a detector array comprising, for example, semiconductor materials, is mounted in a vacuum vessel (or "dewar"). The outer wall of the dewar forms a well ("coldwell"), typically cylindrical in shape, which intrudes into the body of the vessel, forming a sleeve which holds the cooling member (or "coldfinger") of the refrigerator. The detector assembly is mounted inside the dewar at the end of the cylindrical well ("endwell"), in thermal contact with the coldfinger. Infrared energy passes through a window in the outer wall of the dewar, striking the detector assembly mounted on the endwell.

The design of the thermal interface between detector and refrigerator assemblies is difficult because of the modular design of the assemblies (which is the result of other system constraints) and because of the range of temperatures the device is exposed to (typically 77K to 300K). First, the coupler must provide good thermal conductance between the coldwell and coldfinger. Second, in order to do this, the thermal coupler must include some means of adjusting to the variable distance between the coldfinger and coldwell ends caused by the accumulation of mechanical tolerances in the cooler/coldfinger and dewar and for differences in material contractions when cooled to operating temperature. Third, the thermal coupler must minimize vibration transmitted to the detector assembly from the refrigerator to the coldwell, because the glass endwell and detector assemblies are fragile, and because transmitted vibrations may result in microphonic image degradation.

The thermal coupler design problem has been solved in a number of ways. One method has been to insert a "fuzz button" comprising gold coated copper wool which has been impregnated with a thermally conductive grease into the gap between coldfinger and endwell, thus providing physical as well as thermal contact between subassemblies. This approach has had several problems. First, because of the inelasticity of the copper wool, the button has to be replaced each time the unit is disassembled, making field repairs difficult. Second, it is difficult to guage the amount of wool required to fill the gap which varies from unit to unit because of the different tolerance build-ups, resulting in unpredictable thermal conductivity. As a result, a highly skilled technician is required to install the fuzz button. Third, if too large a button is inserted in the coldwell, the glass endwell may fracture when the unit is assembled.

In a second thermal coupler design (U.S. Pat. No. 3,999,403, entitled "Thermal Interface for Cryogen Coolers"), heat transfer is provided by a thermally conductive bellows placed between the coldfinger and endwell. The bellows expands or contracts as the coldfinger length changes in response to temperature changes, or to accommodate differences in tolerance build-up between units. This design has the disadvantages that the bellows travel is generally limited, and that the thermal conductivity is generally low because of the bellows structure.

In another design, (U.S. Pat. No. 3,851,173, entitled "Thermal Energy Receiver"), the thermal coupler comprises a spring loaded cap mounted over the end of the coldfinger, such that the cap and endwell are in physical and thermal contact. A flexible conductive material connects cap and coldfinger to provide increased thermal transfer between the two. An adapter having an "H"-shaped cross-section fits over, and is brazed onto the coldfinger. The upper portion of the adapter is open and seats a coil spring together with the flanged cap which engages the detector endwell by pressure of the spring. The heat transfer mechanism is primarily through the spring and cap, or if necessary through an additional flexible conductive cable placed between the cap and "H"-shaped adapter. This configuration has several disadvantages. First, because of the high spring pressure required to affect good thermal transfer, the coupler also tends to transmit vibration from the refrigerator motor to the detector assembly, which may stress or fracture the endwell, detector assembly or both. A second disadvantage is that it requires a larger coldwell diameter which may not be practical given other system design constraints. Another disadvantage of this design is that thermal grease placed between the cap and endwell to improve thermal transfer may enter the inner gap between the adapter and cap. As a result, when the device cools, thermal grease in the inner gap may freeze, locking the cap to the coldfinger so that as the coldfinger shrinks, the cap pulls away from the endwell, thereby decreasing the coupler's thermal conductivity, and thereby increasing the possibility of mechanical vibration of the detector. Another disadvantage is that the maximum length of the assembly is not mechanically constrained so that repair of the unit in the field is more complicated.

In a fourth coupler design (U.S. Pat. No. 4,324,104, entitled "Noncontact Thermal Interface"), a cap-shaped adapter, matched to the shape of the endwell, is fixed to the end of the coldfinger. Thermally conductive shims are placed between the cap and the coldfinger to adjust the gap between the adapter and endwell. The contours of the adapter/shim and endwell are matched such that the gap between the two is approximately one ten thousandth (0.0001) of an inch, the smallest gap practicable while taking into account the differential expansion rates of the metal coldfinger and glass coldwell. A thermally conductive hydrocarbon or inert gas is placed in the gap between the endwell and adapter to improve thermal coupling. It should be noted that because the cooling function of the refrigerator is directed to the end of the coldfinger, the performance of this coupler depends primarily on maintenance of the gap between adapter and endwell on radial and axial surfaces. Thus, one of the disadvantages of this design is that it requires separate measurement of each device, and physical accommodation for the differences in length between the coldfinger and coldwell. Thus, this design is not generally suited for a production environment. A second disadvantage is that because the gap is difficult to maintain along the axial surfaces of the adapter and endwell, there is generally a large temperature drop across the end surface of the endwell and interchangeability of couplers between units is most likely not possible.

It is accordingly an object of the present invention to provide an improved heat transfer mechanism between the cooler and detector of an infrared receiver mounted in a vacuum dewar vessel.

Another object of the present invention to provide a device for integration of a cryogenic cooler with a detector dewar assembly which will automatically accommodate tolerance differences in size between the cooler and detector dewar subassemblies.

It is a further object of the present invention to provide an infrared receiver having increased cooling capacity with reduced physical contact between the cooler and detector assemblies such that vibration effects are minimized.

Still another object of the present invention is to provide a thermal coupler assembly which is both easy to assemble, measure, and test, and is easily integrated into an infrared receiver.

SUMMARY OF THE INVENTION

The above and other objects of the present invention are achieved by providing a thermal coupler which does not rely solely on either direct contact designs, which typically have vibration problems, or on noncontact thermal transfer design principles, which require accurate measurement of the relative lengths of the coldfinger and coldwell to affect optimum thermal transfer. The thermal coupler of the present invention uses the principle of noncontact thermal transfer between the radial surfaces of a cylindrical stud mounted on the coldfinger end, and a surrounding cap, which is held in place by a low strength spring between stud and cap and a retaining pin. Thermal transfer to the endwell is primarily through gas or air in the gap between stud and cap (which is a controlled tolerance), and by light but direct contact of the cap and coldwell at the endwell, and by gas or air trapped between the cap and coldwell walls on their radial surfaces. The stud diameter is less than that of the coldfinger, such that the cap may closely fit both the stud and the inner coldwell diameter without redesign. The low strength spring placed between the stud and cap improves alignment and initial positioning of the cap without creating vibration problems. The cap is captured by a pin through the stud so that the coupler remains in one piece when the system is disassembled. The pin may be bonded, such as by soldering, to the cap after assembly of the coupler.

BRIEF DESCRIPTION OF THE DRAWINGS

The above and other objects of the present invention are achieved in the illustrative embodiment as described with respect to the figures in which.

DETAILED DESCRIPTION OF THE PREFERRED EMBODIMENT(S)

Figure 1:
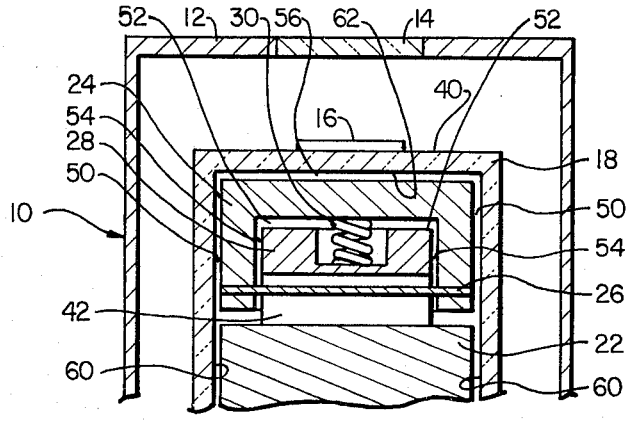
FIG. 1 shows a cross-section through the thermal coupler assembly of the present invention in place between a coldfinger and vacuum dewar assembly holding a infrared detector assembly.

Referring to FIG. 1, a portion of an infrared receiver is shown, specifically the portion comprising the thermal interface between the coldfinger 22 of a cryogenic refrigerator (not shown), and a portion of a vacuum dewar assembly 10 which houses detector assembly 16. The detector assembly 16 is positioned on surface 40 of coldwell 18, facing window 14 in wall 12 of dewar 10 which allows the transmission of energy of the appropriate wavelengths to detector assembly 16.

Figure 2:
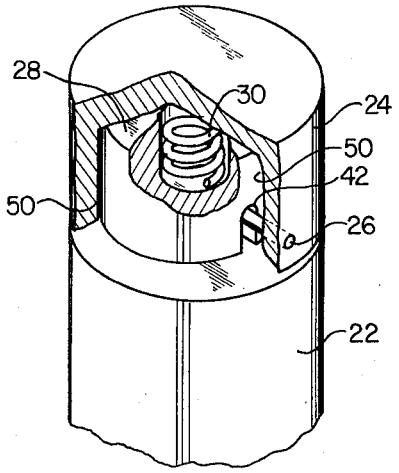
FIG. 2 shows a cut-away isometric view of the thermal coupler assembly of the present invention in place on a coldfinger assembly.

Referring to FIG. 2, the thermal coupler of the present invention comprises a cylindrical stud 28 with matching up-shaped cap 24, biasing spring 30 which separates stud 28 and cap 24, and retaining pin 26 which sits in slot 42 of stud 28, limiting the maximum displacement of cap 24. The pin 26 may be bonded, such as by soldering, to the cap 24 after assembly of the coupler. Stud 28, cap 24 and pin 26 are all made of a corrosion resistant, high thermal conductivity metal which has the appropriate structural characteristics. This might include high purity nickel (i.e. 99.5% pure, or better), silver, or gold alloys. Spring 30 comprises a corrosion resistant metal, e.g., cadmium plated steel, having relatively low spring tension.

The thermal coupler comprising parts 24, 26 28 and 30 is designed such that air gaps 50, 52 and 54 between the inner wall 60 of coldwell 18 and cap 24, and between cap 24 and stud 28 are 0.0005 inches wide, or less. The diameter of the stud 28 is selected to maximize contact area with coldfinger 22, in order to reduce thermal gradients between the coupler and coldfinger, and to improve coupler performance. In addition, the inner diameter of the cap 24 is selected such that the thickness of radial end portions of cap 24 minimize thermal gradients between coldwell 18 and coldfinger 22, while providing necessary structural integrity. In one embodiment, the thickness of cap 24 is uniform along radial and axial surfaces.

The lengths of stud 28 and cap 24 are selected to maximize the overlap of cap 24 and stud 28 surfaces adjoining gap 54, thus providing maximum thermal transfer radially across gap 54, and providing thermal transfer between cap 24 and surface 62 of coldwell 18 for the full range of accumulated tolerances caused by manufacturing errors and thermal effects.

Stud 28 is mounted on the coldfinger 22 using a high thermal conductivity bonding method (e.g., soldering), or in an alternate embodiment may comprise an extension of coldfinger 22. When the coldfinger 22 with coupler is inserted into coldwell 18, spring 30 extends, placing the cap 24 into contact with surface 62 of coldwell 18. If necessary, thermal grease or some other thermally conductive material may be placed in gap 56 in order to maximize thermal transfer. If such grease or material is not used, then gap 56 would be eliminated such that surface 62 of coldwell 18 and cap 24 are in physical contact.

Having described the invention, what is claimed as new and novel and for which it is desired to secure Letters Patent is:

1. An infrared energy receiver for measuring infrared energy from a scene of interest, said receiver comprising:

A. coldfinger cooling means having a first end;

B. a coldwell having an inner diameter greater than the outer diameter of said coldfinger cooling means, the difference in diameters of said coldfinger cooling means and said coldwell sufficient to enable said coldfinger cooling means to fit within said coldwell, said coldwell having a second end in a spaced relationship with said first end of said coldfinger cooling means, said second end having an inner surface facing said coldfinger and an outer surface directed toward said scene of interest, said coldwell also having an interior cylindrical surface to which said inner surface is contiguous at said second end;

C. infrared energy detector means coupled to said outer surface of said second end of said coldwell;

D. thermal coupler subassembly means for transmitting heat from said infrared energy detector means to said coldfinger cooling means, said thermal coupler subassembly means having an overall diameter selected to maximize heat transfer from said detector means to said coldfinger cooling means while maintaining a spaced relationship to minimize physical contact with said interior cylindrical surface of said coldwell, said subassembly means comprising:

(i) cylindrical means coupled to said first end of said coldfinger, said cylindrical means having a depression substantially in the shape of a well, said depression facing in the direction of said inner surface of said second end of said coldwell;

(ii) a "U"-shaped cap having an outer diameter the same as the diameter of said coupler subassembly means, and an inner diameter substantially the same as the diameter of said cylindrical means such that said cap and said cylindrical means are in a spaced relationship providing thermal transfer and ease of relative motion while minimizing physical contact; and (iii) spring means placed in said depression of said cylindrical means, said spring means positioned between said cylindrical means and said cap in order to maintain thermal transfer between said cap and said inner wall of said coldwell, the tension of said spring means selected to minimize transmission of vibration from said coldfinger cooling means to said detector means while providing said thermal transfer.

2. Apparatus as in claim 1 wherein said cap and said cylindrical means comprise a material having high thermal conductivity.

3. Apparatus as in claim 2, wherein said material is noncorrosive and comprises either high purity nickel, silver or gold alloy.

4. Apparatus as is claim 1 wherein said spring means comprises steel wire coated with cadmium.

5. Apparatus as in claim 1 further comprising means for securing said cap to said cylindrical means while maintaining means for movement of said cap with respect to said cylindrical means due to pressure provided by said spring means.

6. Apparatus as is claim 5 wherein said means for securing said cap comprises:

A. slot means in the base of said cylindrical means, said slot means substantially perpendicular to the longitudinal axis of said cylindrical means, and wherein said slot means having a height (measured along said longitudinal axis of said cylindrical means) substantially equal to a desired range of movement of said cap relative to said cylindrical means; and B. pin means positioned with said slot means, wherein said pin means is coupled to said cap such that the movement of said cap is restricted to the desired range of movement defined by said slot means.

7. Apparatus as in claim 1 wherein a thermally conductive material is included between said cap and said inner surface of said coldwell in order to improve thermal transfer between said detector means and said coldfinger cooling means.

8. Apparatus as in claim 7 wherein said thermally conductive material comprises a thermally conductive grease and wherein said cap is shaped such that said thermally conductive grease is substantially prevented from entering the space between said cylindrical means and said cap.

* * * * *